US007954190B2

(12) United States Patent
Zhang et al.

(10) Patent No.: US 7,954,190 B2
(45) Date of Patent: Jun. 7, 2011

(54) PROCESS FOR INCREASING LIQUID EXTRACTION FROM FABRICS

(75) Inventors: Shulin Larry Zhang, West Chester, OH (US); Joseph Dean Heatherly, Morrow, OH (US); Vicente Santamarina, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 867 days.

(21) Appl. No.: 10/865,123

(22) Filed: Jun. 10, 2004

(65) Prior Publication Data

US 2004/0255395 A1 Dec. 23, 2004

Related U.S. Application Data

(60) Provisional application No. 60/479,689, filed on Jun. 19, 2003.

(51) Int. Cl.
*D06F 39/00* (2006.01)
*C11D 3/00* (2006.01)

(52) U.S. Cl. ..... 8/159; 510/276; 510/521; 510/524

(58) Field of Classification Search ..... 8/159; 134/42
See application file for complete search history.

(56) References Cited

U.S. PATENT DOCUMENTS

| | | | | |
|---|---|---|---|---|
| 3,982,325 | A | 9/1976 | Sigl et al. | |
| 4,043,923 | A * | 8/1977 | Loudas | 252/8.62 |
| 4,160,777 | A * | 7/1979 | Loudas | 558/54 |
| 4,290,896 | A | 9/1981 | Gordon et al. | |
| 4,434,196 | A | 2/1984 | Robinson et al. | |
| 4,643,919 | A * | 2/1987 | Fu | 427/393.1 |
| 4,795,032 | A * | 1/1989 | Kandathil | 8/137 |
| 4,810,253 | A * | 3/1989 | Kasprzak et al. | 8/137 |
| 4,848,981 | A | 7/1989 | Kasprzak et al. | |
| 5,021,285 | A | 6/1991 | Ohe et al. | |
| 5,045,225 | A * | 9/1991 | Aronson et al. | 510/466 |
| 5,719,039 | A * | 2/1998 | Dordick et al. | 435/41 |
| 5,763,382 | A * | 6/1998 | Cooper et al. | 510/303 |
| 5,942,217 | A * | 8/1999 | Woo et al. | 424/76.1 |
| 6,010,539 | A * | 1/2000 | Del Pesco | 8/137 |
| 6,169,063 | B1 * | 1/2001 | Kvietok et al. | 510/317 |
| 6,180,593 | B1 * | 1/2001 | Fender et al. | 510/515 |
| 6,291,013 | B1 * | 9/2001 | Gibson et al. | 427/213.3 |
| 6,503,413 | B2 * | 1/2003 | Uchiyama et al. | 252/8.91 |
| 7,018,977 | B2 * | 3/2006 | Martens et al. | 510/521 |
| 7,026,278 | B2 * | 4/2006 | Price et al. | 510/522 |
| 2001/0049247 | A1 | 12/2001 | Mellea et al. | |
| 2002/0064639 | A1 | 5/2002 | Rearick et al. | |
| 2006/0157088 | A1 * | 7/2006 | Carter et al. | 134/42 |

FOREIGN PATENT DOCUMENTS

| | | | |
|---|---|---|---|
| EP | 0224839 | B1 | 7/1989 |
| EP | 0200325 | B1 | 6/1990 |
| EP | 0319536 | B1 | 3/1992 |
| EP | 0324861 | B1 | 10/1993 |
| GB | 1459013 | | 3/1975 |
| GB | 1491603 | A | 11/1977 |
| JP | 61207672 | A2 | 9/1986 |
| JP | 02165829 | A | 6/2002 |
| WO | WO9927050 | * | 6/1999 |
| WO | WO 01/16264 | A | 3/2001 |

* cited by examiner

*Primary Examiner* — Michael Kornakov
*Assistant Examiner* — Nicole Blan
(74) *Attorney, Agent, or Firm* — Mark Charles; David V Upite; Melissa G Krasovec

(57) ABSTRACT

The present invention relates to a process of increasing liquid extraction from fabrics having a first liquid content through the use of a mechanical extraction means and a liquid extraction agent.

14 Claims, 1 Drawing Sheet

PROCESS FOR INCREASING LIQUID EXTRACTION FROM FABRICS

CROSS REFERENCE TO RELATED APPLICATION

This application claims the benefit under 35 USC 119(e) to U.S. Application No. 60/479,689, filed Jun. 19, 2003.

This invention was made with Government support under Government Contract DE-FC26-01NT41261, awarded by DOE. The Government has certain rights in this invention.

FIELD OF THE INVENTION

The present invention relates to a process of increasing liquid extraction from fabrics having a liquid content through the use of a liquid extraction agent.

BACKGROUND OF THE INVENTION

The amount of liquid remaining in fabric at the end of a washing cycle increases the time and energy required to dry the fabric. The reduction in the amount of time and energy in drying the fabric has been of great interest to consumers. Some art has addressed this problem but has attempted to solve the issue by teaching modification of fabric to be less absorbent or to affect the surface of the fabric by deposition of some specified agents. However, modifying a fabric surface often fails to achieve the ideal reduction of time and energy desired by consumers. Therefore, there exists a need to effectively reduce the amount of liquid remaining in clothing at the end of a washing cycle.

SUMMARY OF THE INVENTION

The present invention relates to a process of increasing liquid extraction from fabric having a first liquid content comprising the steps of; (a) contacting the fabric with at least one liquid extraction agent; and (b) subjecting the fabric to mechanical extraction to reduce the liquid content in the fabric to a second liquid content; wherein the liquid extraction agent is capable of reducing the surface tension of the liquid content to 40 mN/m or less. Another embodiment of the process of the present invention comprises the steps of: (a) contacting the fabric with an effective amount of a liquid extraction agent; (b) subjecting the fabric to mechanical extraction to reduce the liquid content of the fabric from a first liquid content to a second liquid content; wherein the liquid extraction agent has a critical micelle concentration of from about 10 ppm to about 1500 ppm at a liquid extraction agent concentration of from about 10 ppm to about 3000 ppm.

DETAILED DESCRIPTION OF THE INVENTION

Figure 1:
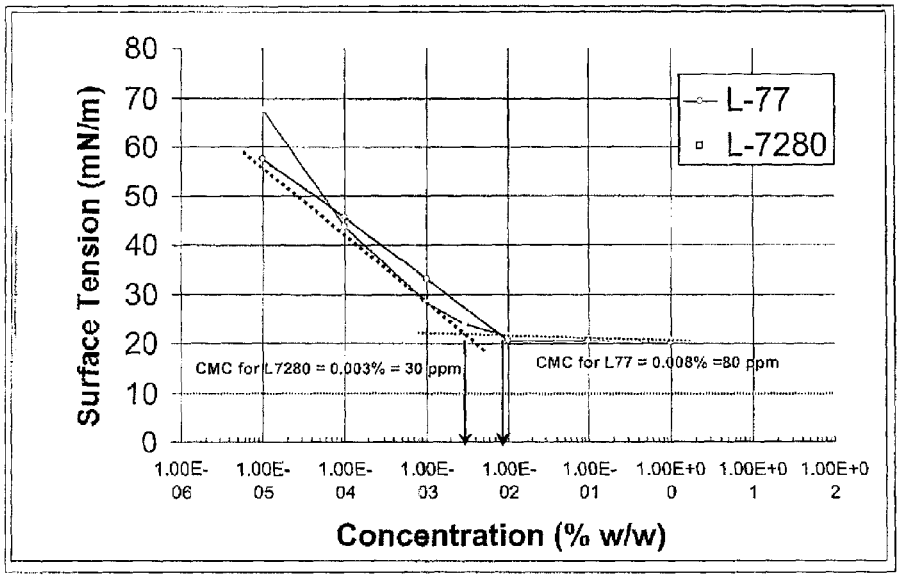
FIG. 1 is a Surface Tension Profile of Silwet L-77 and L7280, as reported by the supplier (OSI Specialties).

The amount of liquid remaining in clothing at the end of a washing cycle increases the time and energy required to dry consumer bundles of fabrics. The reduction of time and energy in drying laundry has been of great interest to consumers. A real challenge in drying laundry is to achieve the desired reduction in drying time and energy for an average consumer bundle of fabrics, which comprise various fabric types having different water retention properties. For example, an average consumer bundle of fabric may comprise a mixture of cotton towels in the same consumer bundle as synthetic/cotton mixed fabric clothing. Perceived "hard-to-dry" items such as cotton fabrics with thicker weaves often result in the longest drying time and highest energy requirements, even after the use of mechanical drying means such as washing machines with a spin stage. An additional issue facing consumers is the effective distribution of benefit agents added to a washing process. Most consumers desire that one dose added during the washing process be effective in delivering benefit agents for an entire consumer bundle. Without effective distribution, the desired consumer benefit from the added benefit agent is not always obtained. Therefore, an identified problem in increasing the liquid extraction of fabric having a first liquid content to a reduced second liquid content is the effective distribution of the liquid extraction agents throughout the consumer bundle during a washing process.

Incorporated and included herein, as if expressly written herein, are all ranges of numbers when written in a "from X to Y" or "from about X to about Y" format. It should be understood that every limit given throughout this specification will include every lower, or higher limit, as the case may be, as if such lower or higher limit was expressly written herein. Every range given throughout this specification will include every narrower range that falls within such broader range, as if such narrower ranges were all expressly written herein.

Process

The present invention relates to a process of increasing liquid extraction from fabric having a first liquid content to a reduced second liquid content through the use of a mechanical extraction means and a liquid extraction agent capable of reducing the surface tension of the liquid content to about 40 mN/m or less. Another embodiment comprises the use of a mechanical extraction means and a liquid extraction agent having a critical micelle concentration of from about 10 ppm to about 1500 ppm at a concentration of liquid extraction agent from about 10 ppm to 3000 ppm. The liquid extraction agent is utilized during the washing process, which is commonly accomplished through the use of a washing machine having a mechanical extraction means such as a spin stage. As used herein "a reduced second liquid content" means a liquid content that would be less than that achieved by use of a mechanical extraction means alone.

The washing cycles of a typical washing machine comprise the following stages. First the washing machine, after being loaded with the desired fabrics, has a "washing stage," which, as used herein, refers the stage where the washing machine fills with water to a predetermined volume, agitates for a specified period of time, drains the washing liquor, and then the machine spins the fabrics. During the washing stage, fabrics become wet with the wash liquor and have a first liquid content. "Rinse stage" as used herein refers the next stage wherein the washing machine fills with water to a predetermined volume, agitates for a specified period of time, and then drains the water as the machine spins the fabrics. During the spinning and draining portion of the rinse stage, some washing machines have a small amount of water dropping onto the fabric. "Splash" as used herein refers to water dropped onto the fabrics during the rinse stage, but not retained or held in the washing machine. After the rinse stage, a type of mechanical extraction means to further remove liquid from the fabrics may be used. It is intended that the claimed process of the present invention encompass mechanical extraction means separate from a washing machine as well as mechanical extraction means incorporated as part of the washing machine. The "spin stage" as used herein, refers to a stage wherein the washing machine incorporates a mechanical extraction means, preferably wherein the washing machine spins for a specified period of time without the addition of water to the washing machine.

The liquid extraction agent may be added at any time during the washing process. In one preferred embodiment the liquid extraction agent is contacted with the fabric having a first liquid content during the washing stage. In another preferred embodiment, the liquid extraction agent is contacted with the fabric having a first liquid content during the rinse stage. In another preferred embodiment, the liquid extraction agent is contacted with the fabric having a first liquid content immediately prior to any mechanical extraction, preferably immediately prior to the spin stage. In yet another preferred embodiment the liquid extraction agent is contacted with the fabric having a first liquid content during the splash portion of the rinse stage. The liquid extraction agent may be added in a one dose form at any of these stages. The addition of the liquid extraction agent during any of these stages then results in a reduced second liquid content when the mechanical extraction means is applied.

The process can further comprise the step of subjecting the fabric to mechanical drying, air-drying, or a combination thereof. As used herein "air drying" includes indoor or outdoor drying, such as line drying. Mechanical drying means is preferably vacuum drying or heat drying such as that occurs in commercial or in-home drying machines.

As used herein "fabric" refers the natural, synthetic, and mixed natural/synthetic materials, including but not limited to silk, wool, cotton, rayon, nylon, polyesters, lycra, and spandex.

As used herein "liquid" refers to any aqueous bases material that can have a liquid form at room temperatures (about 0° C. to about 60° C.) or can comprise a mixture of liquid and vapor phases at ambient temperatures and pressures, e.g., at 25° C. and 101 kPa (1 atm) pressure. As used herein "liquid" further refers to a pure liquid, a solution, or a colloid suspension of solids in an aqueous material, such as water.

As used herein "liquid content" refers to the liquid held interstitially in a fabric weave or structure such as void spaces. The liquid content may range from saturated to dry. "Dry" as used herein refers to fabric that has no damp feel when touched. "Saturated" as used herein refers to fabric that has the maximum liquid content of the fabric.

As used herein, an "effective amount" refers to an amount of a material or additive that when utilized delivers a perceivable benefit, such as the amount of water extracted from fabric.

Liquid Extraction Agent

The liquid extraction agent or mixtures of such liquid extraction agents to be used in the process of the present invention is capable of reducing the surface tension of the liquid content to about 40 nN/m or less; preferably about 30 mN/m or less, more preferably about 20 mN/m or less. Without being limited by a theory, it is believed that the reduction in surface tension of the liquid content trapped by capillary forces interstitially in the fabric weave or in void spaces, results in larger volumes of the liquid content being removed from the fabric by the same amount of mechanical extraction. Unlike prior art, the liquid extraction agent is not required to be deposited or attached to the fabric surface or fiber after the final rinse. Therefore, the liquid extraction agents of the present invention encompass agents that are not required to modify the surface properties of the fabric, but rather modify the properties of the liquid in the fabric fibers. It is also preferred that the liquid extraction agent does not result in excessive foaming as it is added in during the washing process and the fabric does not need to be further contacted with additional liquid to eliminate any foaming that results there from.

The liquid extraction agents of the present invention preferably have a critical micelle concentration of from about 10 ppm to about 1500 ppm; preferably from about 10 to about 300 ppm, more preferably from about 10 to about 100 ppm. The critical micelle concentration is measured via a 5 minute reading according to ASTM D1173-53. Without being limited by a theory, it is believed that careful selection of a liquid extraction agent is necessary in order to achieve the optimum surface tension reduction with the least amount of material added into the laundry process under common consumer conditions. Another aspect of the present invention comprises a process wherein the liquid extraction agent is chosen such that the critical micelle concentration of from about 10 ppm to about 1500 ppm; preferably from about 10 to about 300 ppm, more preferably from about 10 to about 100 ppm is delivered during the rinse stage at concentrations of about 10 ppm to about 3000 ppm, preferably about 10 ppm to about 1500 ppm, most preferably from about 10 ppm to about 300 ppm, based on a predetermined volume of liquid available during the washing stage or the rinse stage or the water available during the splash. Preferably the liquid extraction agent is sufficiently dispersible in the predetermined volume of liquid in the washing stage or the rinse stage so that an effective amount of liquid extraction agent is distributed throughout the consumer bundle of fabric.

Preferred liquid extraction agents include silicone compounds, anionic surfactants, cationic surfactants, nonionic surfactants, zwitterionic surfactants, fluorosurfactants, and any combination thereof.

Silicone Compounds And Emulsions—Silicone compounds and emulsions of silicone compounds are preferred liquid extraction agents. Due to the versatility of silicone chemistry a variety of silicones, organo-silicones, substituted silicones compounds as well as emulsions of silicone compounds are offered by many manufacturers and therefore silicone compounds and emulsions offer a diverse array of benefits for the present invention.

Since a variety of silicones are available, specific silicones may be chosen for specific usage situations. In cases when the liquid extraction agents tend to foam during processing or in use, silicone suds suppressors for foam control may be used. Combinations of silicones are also useful in the present composition to achieve a benefit or a combination of benefits.

A preferred, but nonlimiting class of nonionic silicone surfactants are the polyalkylene oxide polysiloxanes. Typically the polyalkylene oxide polysiloxanes have a dimethyl polysiloxane hydrophobic moiety and one or more hydrophilic polyalkylene oxide chains. The hydrophilic polyakylene oxide chains can be incorporated as side chains (pendant moieties) or as block copolymer moieties with the polysiloxane hydrophobic moiety. Polyalkylene oxide polysiloxanes are described by the following general formula (I):

$$R^1—(CH_3)_2SiO—[(CH_3)_2SiO]_a—[(CH_3)(R^1)SiO]_b—Si(CH_3)_2—R^1 \quad (I)$$

wherein a+b of formula (I) are from about 1 to about 50, preferably from about 1 to about 30, more preferably from about 1 to about 25, and each $R^1$ of formula (I) is the same or different and is selected from the group consisting of methyl and a poly(ethyleneoxide/propyleneoxide) copolymer group having the general formula (II):

$$—(CH_2)_nO(C_2H_4O)_c(C_3H_6O)_dR^2 \quad (II)$$

wherein n of formula (II) is 3 or 4, preferably 3; c of formula (II), for all polyalkyleneoxy side groups, has a value of from 1 to about 100, preferably from about 6 to about 100; wherein c+d of formula (II) has a value of from about 5 to about 150, preferably from about 7 to about 100; and each $R^2$ of formula (II) is the same or different and is selected from the group consisting of hydrogen, an alkyl having 1 to 4 carbon atoms, an acetyl group, and mixtures thereof; preferably $R^2$ of formula (II) is selected from hydrogen and/or methyl group. Each polyalkylene oxide polysiloxane has at least one $R^1$ of formula (I) being a poly(ethyleneoxide/propyleneoxide)copolymer group.

Nonlimiting examples of these types of surfactants are the SILWET® surfactants, which are available from OSI Specialties Inc., now a Division of General Electric Company, Tarrytown, N.Y. Representative SILWET® surfactants that contain only ethyleneoxy ($C_2H_4O$) groups are as follows.

| Name | Weight Average MW |
|---|---|
| L-7608 | 600 |
| L-7607 | 1,000 |
| L-77 | 600 |
| L-7605 | 6,000 |
| L-7604 | 4,000 |
| L-7600 | 4,000 |
| L-7657 | 5,000 |
| L-7602 | 3,000 |
| L-7622 | 10,000 |
| L-8600 | 2,100 |
| L-8610 | 1,700 |
| L-8620 | 2,000 |

Nonlimiting examples of a SILWET® surfactants that contain both ethyleneoxy ($C_2H_4O$) and propyleneoxy ($C_3H_6O$) groups are:

| Name | Weight Average MW | EO/PO ratio |
|---|---|---|
| L-7001 | 20,000 | 40/60 |
| L-7002 | 8,000 | 50/50 |
| L-7087 | 20,000 | 40/60 |
| L-7280 | 600 | 45/55 |

Nonlimiting examples of SILWET® surfactants that contain only propyleneoxy ($C_3H_6O$) groups are as follows:

| Name | Weight Average MW |
|---|---|
| L7500 | 3,000 |
| L7550 | 300 |
| L8500 | 2,800 |

The weight average molecular weight of the polyalkyleneoxide polysilioxane is less than or equal to about 10,000 daltons. Preferably, the weight average molecular weight of the polyalkyleneoxide polysilioxane is less than or equal to about 8,000 daltons, and most preferably ranges from about 300 daltons to about 5,000 daltons. Thus, the values of a, b, c and d of formulae (I) and (II) can be those numbers that provide weight average molecular weights within these ranges. However, the number of alkoxy units (—$C_2H_4O$ or —$C_3H_6O$) in the polyether chain ($R^1$ of formula (I)) must be sufficient to render the polyalkylene oxide polysiloxane water dispersible or water soluble. If propyleneoxy groups are present in the polyalkylenoxy chain, they can be distributed randomly in the chain or exist as blocks. Preferred SILWETS® provide the greatest surface tension reduction within desired critical micelle concentrations. Nonlimiting examples of preferred SILWETS® include L7001, L7002, L7087, L7280, L7608 and L77. Other nonlimiting examples polyalkylene oxide polysiloxanes useful in the present invention include the following compounds available from DOW CORNING® 190 Surfactant, 193 Surfactant, FF-400 Fluid, Q2-5220, Q4-3667, Q2-5211, Q2-5211 SYLGARD® 309 as well as compounds available from Toray Dow Corning Silicone Co., Ltd. known as SH3771C, SH3772C, SH3773C, SH3746, SH3748, SH3749, SH8400, SF8410, and SH8700, KF351 (A), KF352 (A), KF354 (A), and KF615 (A) of Shin-Etsu Chemical Co., Ltd., TSF4440, TSF4445, TSF4446, TSF4452 of Toshiba Silicone Company, and SF1488 of GE Silicones. Mixtures of silicone surfactants such as SILWET® surfactants with preferred properties are also preferred.

The preparation of polyalkylene oxide polysiloxanes is well known in the art. Polyalkylene oxide polysiloxanes of the present invention can be prepared according to the procedure set forth in U.S. Pat. No. 3,299,112. Typically, polyalkylene oxide polysiloxanes of the present invention are readily prepared by an addition reaction between a hydrosiloxane (e.g., a siloxane containing silicon-bonded hydrogen) and an alkenyl ether (e.g., a vinyl, allyl, or methallyl ether of an alkoxy or hydroxy end-blocked polyalkylene oxide). The reaction conditions employed in addition reactions of this type are well known in the art and in general involve heating the reactants (e.g., at a temperature of from about 85° C. to 110° C.) in the presence of a platinum catalyst (e.g., chloroplatinic acid) and a solvent (e.g., toluene).

Surfactants—Other preferred liquid extraction agent according to the present invention may comprise a surfactant or surfactant system comprising surfactants selected from nonionic, anionic, cationic surfactants, ampholytic, zwitterionic, semi-polar nonionic surfactants, other adjuncts such as alkyl alcohols, or mixtures thereof. Non-limiting examples of anionic surfactants include, mid-chain branched alkyl sulfates, modified linear alkyl benzene sulfonates, alkylbenzene sulfonates, linear and branched chain alkyl sulfates, linear and branched chain alkyl alkoxy sulfates, and fatty carboxylates. Non-limiting examples of nonionic surfactants include alkyl ethoxylates, alkylphenol ethoxylates, and alkyl glycosides. Other suitable surfactants include amine oxides, quaternery ammonium surfactants, and amidoamines.

Anionic Surfactants

Nonlimiting examples of anionic surfactants useful herein include:

a) $C_{11}$-$C_{18}$ alkyl benzene sulfonates (LAS);

b) $C_{10}$-$C_{20}$ primary, branched-chain and random alkyl sulfates (AS);

c) $C_{10}$-$C_{18}$ secondary (2,3) alkyl sulfates having formulae (III) and (IV):

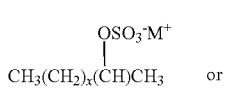

(III)

or

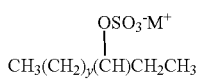

(IV)

M in formulas (III) and (IV) is hydrogen or a cation which provides charge neutrality. For the purposes of the present invention, all M units, whether associated with a surfactant or adjunct ingredient, can either be a hydrogen atom or a cation depending upon the form isolated by the artisan or the relative pH of the system wherein the compound is used. Non-limiting examples of preferred cations include sodium, potassium, ammonium, and mixtures thereof. Wherein x in formulas (III) and (IV) is an integer of at least about 7, preferably at least about 9; y in formulas (III) and (IV) is an integer of at least 8, preferably at least about 9;

d) $C_{10}$-$C_{18}$ alkyl alkoxy sulfates ($AE_xS$) wherein preferably x is from 1-30;

e) $C_{10}$-$C_{18}$ alkyl alkoxy carboxylates preferably comprising 1-5 ethoxy units;

f) mid-chain branched alkyl sulfates having formula (V):

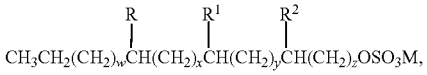

(V)

g) alkyl alkoxy sulfates have formula (VI):

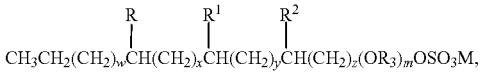

(VI)

wherein for both the mid-chain branched alkyl sulfates and the alkyl alkoxy sulfates R, $R^1$, and $R^2$ in formulas (V) and (VI) are each independently hydrogen, $C_1$-$C_3$ alkyl, and mixtures thereof; provided at least one of R, $R^1$, and $R^2$ in formulas (V) and (VI) is not hydrogen; preferably R, $R^1$, and $R^2$ in formulas (V) and (VI) are methyl; preferably one of R, $R^1$, and $R^2$ in formulas (V) and (VI) is methyl and the other units are hydrogen. The total number of carbon atoms in the mid-chain branched alkyl sulfate and alkyl alkoxy sulfate surfactants is from 14 to 20; the index w in formulas (V) and (VI) is an integer from 0 to 13; x in formulas (V) and (VI) is an integer from 0 to 13; y in formulas (V) and (VI) is an integer from 0 to 13; z in formulas (V) and (VI) is an integer of at least 1; provided w+x+y+z is from 8 to 14 and the total number of carbon atoms in a surfactant is from 14 to 20; $R^3$ in formula (VI) is $C_1$-$C_4$ linear or branched alkylene, preferably ethylene, 1,2-propylene, 1,3-propylene, 1,2-butylene, 1,4-butylene, and mixtures thereof. However, a preferred embodiment of the present invention comprises from 1 to 3 units wherein $R^3$ in formula (VI) is 1,2-propylene, 1,3-propylene, or mixtures thereof followed by the balance of the $R^3$ units in formula (VI) comprising ethylene units. Another preferred embodiment comprises $R^3$ units in formula (VI) that are randomly ethylene and 1,2-propylene units. The average value of the index m in formula (VI) is at least about 0.01. When the index m in formula (VI) has low values, the surfactant system comprises mostly alkyl sulfates with a small amount of alkyl alkoxy sulfate surfactant. Some tertiary carbon atoms may be present in the alkyl chain, however this embodiment is not desired.

M in formulas (V) and (VI) denotes a cation, preferably hydrogen, a water soluble cation, and mixtures thereof. Non-limiting examples of water soluble cations include sodium, potassium, lithium, ammonium, alkyl ammonium, and mixtures thereof.

The preferred mid-chain branched alkyl sulfate and alkyl alkoxy sulfate surfactants of the present invention are "substantially linear" surfactants. The term "substantially linear" is defined for the purposes of the present invention as "alkyl units which comprise one branching unit or the chemical reaction products which comprise mixtures of linear (non-branched) alkyl units and alkyl units which comprise one branching unit". The term "chemical reaction products" refers to the admixture obtained by a process wherein substantially linear alkyl units are the desired product but nevertheless some non-branched alkyl units are formed. When this definition is taken together with preferably one of R, $R^1$, and $R^2$ in formulas (V) and (VI) is methyl and the other units are hydrogen, the preferred mid-chain branched alkyl sulfate and alkyl alkoxy sulfate surfactants comprise one methyl branch, preferably said methyl branch is not on the α, β, carbon atom. Typically the branched chains are a mixture of isomers.

The following illustrate preferred examples of mid-chain branched alkyl sulfate and alkoxy alkyl sulfate surfactants.

Formula (VII) 8-Methylundecyl sulfate:

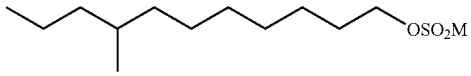

(VII)

Formula (VIII) 3-Methylundecyl sulfate:

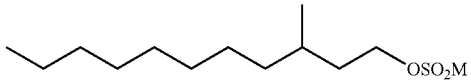

(VIII)

Formula (IX) 3-Methyltridecyl sulfate:

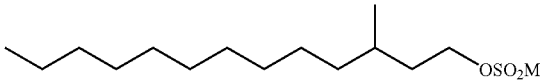

(IX)

Formula (X) 8-Methyltridecyl sulfate:

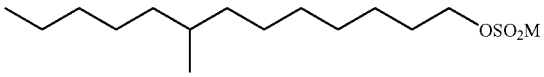

(X)

h) mid-chain branched aryl sulphonates having formula (XII):

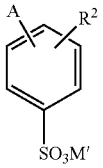

(XII)

wherein A in formula (XII) is a mid-chain branched alkyl unit having formula (XIII):

(XIII)

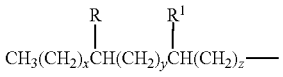

wherein R and $R^1$ in formula (XIII) are each independently hydrogen, $C_1$-$C_3$ alkyl, and mixtures thereof, provided at least one of R and $R^1$ in formula (XIII) is not hydrogen; preferably at least one R or $R^1$ in formula (XIII) is methyl; wherein the total number of carbon atoms in said alkyl unit is from 6 to 18. Some tertiary carbon atoms may be present in the alkyl chain, however, this embodiment is not desired.

The integer x in formula (XIII) is from 0 to 13. The integer y in formula (XIII) is from 0 to 13. The integer z in formula (XIII) is 0 or 1, preferably 0.

$R^2$ in formula (XII) is hydrogen, $C_1$-$C_3$ alkyl, and mixtures thereof. Preferably $R^2$ in formula (XII) is hydrogen.

M' in formula (XII) denotes a water soluble cation with sufficient charge to provide neutrality, preferably hydrogen, a water soluble cation, and mixtures thereof. Non-limiting examples of water soluble cations include sodium, potassium, lithium, ammonium, alkyl ammonium, and mixtures thereof.

In one embodiment of the present invention mid-chain branched aryl sulphonate surfactants are "substantially linear aryl" surfactants. The term "substantially linear aryl" is defined for the purposes of the present invention as "an alkyl unit which is taken together with an aryl unit wherein said alkyl unit preferably comprises one branching unit, however, a non-branched linear alkyl unit having an aryl unit bonded to the 2-carbon position as part of an admixture is included as a substantially linear aryl surfactant". The preferred alkyl units do not have a methyl branch on the second to the last carbon atom. Typically the branched chains are a mixture of isomers. However, in the case of the mid-chained branched aryl sulphonates of the present invention, the relative position of the aryl moiety is key to the functionality of the surfactant. Preferably the aryl moiety is attached to the second carbon atom in the branched chain as illustrated herein below.

In one or more embodiments mid-chain branched aryl sulphonates of the present invention will comprise a mixture of branched chains. Preferably $R^1$ in formula (XIII) is methyl, the index z in formula (XIII) is equal to 0, and the sulphate moiety is para (1,4) to the branched alkyl substituent thereby resulting in a "2-phenyl aryl sulphonate" defined herein by the general formula (XIV):

(XIV)

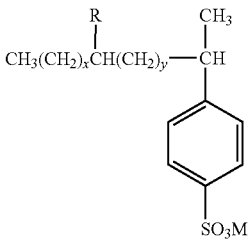

wherein x and y in formula (XIV) are the same as described in formula (XIII).

Typically 2-phenyl aryl sulphonates are formed as a mixture together with "3-phenyl aryl sulphonates" defined herein by the general formula (XV):

(XV)

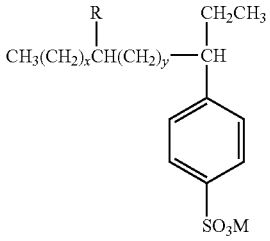

wherein x and y in formula (XV) are the same as described in formula (XIII).

The surfactant properties of the mid-chain branched aryl sulphonates of the present invention can be modified by varying the ratio of 2-phenyl to 3-phenyl isomers in the final surfactant mixture. A convenient means for describing the relative amounts of isomers present is the "2/3 phenyl index" defined herein as "100 times the quotient of the amount of 2-phenyl isomer present divided by the amount of the 3-phenyl isomer which is present". Any convenient means, NMR, inter alia, can be used to determine the relative amounts of isomers present. A preferred 2/3 phenyl index is at least about 275 which corresponds to at least 2.75 times more 2-phenyl isomer present than the 3-phenyl isomer in the surfactant mixture. The preferred 2/3-phenyl index according to the present invention is from about 275, more preferably from about 350, most preferably from about 500 to about 10,000, preferably to about 1200, more preferably to about 700.

Those of ordinary skill in the art will recognize that the mid-chain branched surfactants of the present invention will be a mixture of isomers and the composition of the mixture will vary depending upon the process that is selected by the formulator to make the surfactants. For example, the following admixture is considered to comprise a substantially linear mid-chain branched aryl sulphonate admixture according to the present invention. Sodium para-(7-methylnonan-2-yl) benzenesulphonate, sodium para-(6-methylnonan-2-yl)benzenesulphonate, sodium para-(7-methylnonan-3-yl)benzenesulphonate, sodium para-(7-methyldecan-2-yl) benzenesulphonate, sodium para-(7-methylnonanyl) benzenesulphonate.

Nonionic Surfactants

Non-limiting examples of nonionic surfactants according to the present invention include:

i) $C_{12}$-$C_{18}$ alkyl ethoxylates, inter alia, NEODOL® nonionic surfactants ex Shell;

ii) $C_6$-$C_{12}$ alkyl phenol alkoxylates wherein the alkoxylate units are a mixture of ethyleneoxy and propyleneoxy units;

iii) $C_{12}$-$C_{18}$ alcohol and $C_6$-$C_{12}$ alkyl phenol condensates with ethylene oxide/propylene oxide block polymers inter alia Pluronic® ex BASF;

iv) $C_{14}$-$C_{22}$ mid-chain branched alcohols, BA, having formula (XVI):

(XVI)

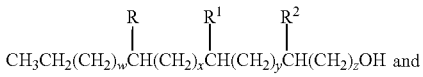

and v) $C_{14}$-$C_{22}$ mid-chain branched alkyl alkoxylates, $BAE_x$, having formula (XVII):

(XVII)

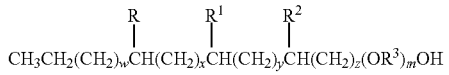

wherein R, $R^1$, and $R^2$ in formulas (XVI) and (XVII) are each independently hydrogen, $C_1$-$C_3$ alkyl, and mixtures thereof; provided at least one of R, $R^1$, and $R^2$ in formulas (XVI) and (XVII) is not hydrogen; preferably R, $R^1$, and $R^2$ in formulas (XVI) and (XVII) are methyl; preferably one of R, $R^1$, and $R^2$ in formulas (XVI) and (XVII) is methyl and the other units are hydrogen. The total number of carbon atoms in the mid-chain branched alkyl sulfate and alkyl alkoxy sulfate surfactants is from 14 to 20; the index w in formulas (XVI) and (XVII) is an integer from 0 to 13; x in formulas (XVI) and (XVII) is an integer from 0 to 13; y in formulas (XVI) and (XVII) is an integer from 0 to 13; z in formulas (XVI) and (XVII) is an integer of at least 1; provided w+x+y+z is from 8 to 14 and the total number of carbon atoms in a surfactant is from 14 to 20; $R^3$ in formula (XVI) is $C_1$-$C_4$ linear or branched alkylene, preferably ethylene, 1,2-propylene, 1,3-propylene, 1,2-butylene, 1,4-butylene, and mixtures thereof; and the average value of the index m in formula (XVI) is at least about 0.01. When the index m in formula (XVI) has low values, the surfactant system comprises mostly alkyl sulfates with a small amount of alkyl alkoxy sulfate surfactant.

vi) Alkylpolysaccharides as disclosed in U.S. Pat. No. 4,565,647 Llenado, issued Jan. 26, 1986;

vii) Polyhydroxy fatty acid amides having formula (XVIII):

(XVIII)

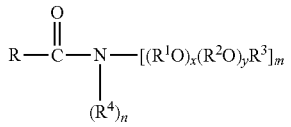

wherein R in formula (XVIII) is $C_7$-$C_{21}$ linear alkyl, $C_7$-$C_{21}$ branched alkyl, $C_7$-$C_{21}$ linear alkenyl, $C_7$-$C_{21}$ branched alkenyl, and mixtures thereof.

$R^1$ in formula (XVIII) is ethylene; $R^2$ in formula (XVIII) is $C_3$-$C_4$ linear alkyl, $C_3$-$C_4$ branched alkyl, and mixtures thereof; preferably $R^2$ in formula (XVIII) is 1,2-propylene. Nonionic surfactants that comprise a mixture of $R^1$ and $R^2$ units in formula (XVIII) preferably comprise from about 4 to about 12 ethylene units in combination with from about 1 to about 4 1,2-propylene units. The units may be alternating, or grouped together in any combination suitable to the formulator. Preferably the ratio of $R^1$ units to $R^2$ units in formula (XVIII) is from about 4:1 to about 8:1. Preferably an $R^2$ unit in formula (XVIII) (i.e., 1,2-propylene) is attached to the nitrogen atom followed by the balance of the chain comprising from 4 to 8 ethylene units.

$R^3$ in formula (XVIII) is hydrogen, $C_1$-$C_4$ linear alkyl, $C_3$-$C_4$ branched alkyl, and mixtures thereof; preferably hydrogen or methyl, more preferably hydrogen.

$R^4$ in formula (XVIII) is hydrogen, $C_1$-$C_4$ linear alkyl, $C_3$-$C_4$ branched alkyl, and mixtures thereof; preferably hydrogen. When the index m in formula (XVIII) is equal to 2 the index n in formula (XVIII) must be equal to 0 and the $R^4$ unit in formula (XVIII) is absent and is instead replaced by a —$[(R^1O)_x(R^2O)_yR^3]$ unit.

The index m in formula (XVIII) is 1 or 2, the index n in formula (XVIII) is 0 or 1, provided that when m in formula (XVIII) is equal to 1, n in formula (XVIII) is equal to 1; and when m in formula (XVIII) is 2 n in formula (XVIII) is 0; preferably m in formula (XVIII) is equal to 1 and n in formula (XVIII) is equal to one, resulting in one —$[(R^1O)_x(R^2O)_yR^3]$ unit and $R^4$ in formula (XVIII) being present on the nitrogen. The index x in formula (XVIII) is from 0 to about 50, preferably from about 3 to about 25, more preferably from about 3 to about 10. The index y in formula (XVIII) is from 0 to about 10, preferably 0, however when the index y in formula (XVIII) is not equal to 0, y in formula (XVIII) is from 1 to about 4. Preferably all of the alkyleneoxy units are ethyleneoxy units. Those skilled in the art of ethoxylated polyoxyalkylene alkyl amide surface active agents will recognized that the values for the indices x and y in formula (XVIII) are average values and the true values may range over several values depending upon the process used to alkoxylate the amides.

Cationic Surfactants

Preferable cationic surfactants are quaternary ammonium surfactants. Preferable quaternary ammonium surfactants are selected from the group consisting of mono $C_6$-$C_{16}$, preferably $C_6$-$C_{10}$ N-alkyl or alkenyl ammonium surfactants, wherein the remaining N positions are substituted by methyl, hydroxyethyl or hydroxypropyl groups. Another preferred cationic surfactant is an $C_6$-$C_{18}$ alkyl or alkenyl ester of an quaternary ammonium alcohol, such as quaternary chlorine esters. More preferably, the cationic surfactants have the formula (XIX):

(XIX)

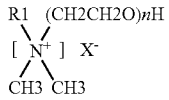

wherein R1 of formula (XIX) is $C_8$-$C_{18}$ hydrocarbyl and mixtures thereof, preferably, $C_{8-14}$ alkyl, more preferably, $C_8$, $C_{10}$ or $C_{12}$ alkyl, and X of formula (XIX) is an anion, preferably, chloride or bromide.

Fluorosurfactants

Fluorosurfactants also may be used as the liquid extraction agent in the present invention. Suitable fluorosurfactants include, anionic fluorosurfactants, including but not limited to fluoroalkyl carboxylates, fluoroalkyl phosphates, fluoroalkyl sulfates; nonionic fluorosurfactants, including but not limited to fluoroalkyl ethoxylates; cationic fluorosurfactants, including but not limited to quaternary ammonium salts; and amphoteric fluorosurfactants, including but not limited to betaine. Preferred fluorosurfactants are available from the DUPONT® Company under the tradename ZONYL®, 3M® under the tradename FLUORAD®, and CLARIANT® under the tradename FLUOWET®.

Adjunct Materials

The liquid extraction agent may further include adjuncts materials to deliver further benefits other than fast drying of the fabrics. The precise nature of these additional components, and levels of incorporation thereof, will depend on the physical form of the liquid extraction agent and the nature of the cleaning operation for which it is to be used. Suitable adjunct materials include, but are not limited to, chelating agents, dye transfer inhibiting agents, dispersants, enzymes, and enzyme stabilizers, brighteners, suds suppressors, dyes, perfumes, structure elasticizing agents, fabric softeners, anti-abrasion agents, carriers, hydrotropes, processing aids and/or pigments, and other fabric care agents. In addition to the disclosure below, suitable examples of such other adjuncts and levels of use are found in U.S. Pat. Nos. 5,576,282, 6,306,812 B1 and 6,326,348 B1.

Liquid Extract Agent Adjuncts

It may be desired in the present invention to use liquid extraction agent adjuncts, assist in achieving the desired results of the present invention and aid in the performance of the liquid extraction agent. Without being limited by a theory, such adjuncts can improve the packing of the liquid extraction agent at the desired interface (e.g., water/air). Liquid extraction agent adjuncts may include alkyl alcohols.

Suds Suppressors

It may be desired in the present invention to use suds suppressors to prevent excess foaming. As used herein "excess foaming" refers to the formation of visible foams on clothes at the end of rinse, or the resulted foam (suds) hindering the spinning action of the washer drum, a phenomenon referred as "suds locking". A wide variety of materials may be used as suds suppressors, and suds suppressors are well known to those skilled in the art. See, for example, Kirk Othmer Encyclopedia of Chemical Technology, Third Edition, Volume 7, pages 430-447 (John Wiley & Sons, Inc., 1979). The present invention may also contain non-surfactant suds suppressors. These include, for example: high molecular weight hydrocarbons, N-alkylated amino triazines, monostearyl phosphates, silicone suds suppressors, secondary alcohols (e.g., 2-alkyl alkanols) and mixtures of such alcohols with silicone oils. Hydrocarbon suds suppressors are described, for example, in U.S. Pat. No. 4,265,779, issued May 5, 1981 to Gandolfo et al. Silicone suds suppressors are well known in the art and are, for example, disclosed in U.S. Pat. No. 4,265,779, issued May 5, 1981 to Gandolfo et al and EP 354 016. Mixtures of alcohols and silicone oils are described in U.S. Pat. Nos. 4,798,679, 4,075,118 and EP 150,872. Additional examples of all of the aforementioned suds suppressors may be found in WO00/27958.

Test Methods

Surface tension and critical micelle concentration (CMC) of the liquid extraction agent should be measure at 25° C. aqueous solution using either DeNouy Ring or Wilhelmy Plate methods. One method of determining the CMC of a liquid extraction agent is to measure the surface tension of the solution containing various concentration of the liquid extraction agent. From the plot of the surface tension versus concentration, one can calculate the CMC of the agent under the specified conditions. An example of this measurement is demonstrated by the below depicted Surface Tension Profile of Silwet L-77 and L7280 as reported by the supplier (OSI Specialties) in FIG. 1.

All documents cited are, in relevant part, incorporated herein by reference; the citation of any document is not to be construed as an admission that it is prior art with respect to the present invention.

What is claimed is:

1. A process for increasing liquid extraction from a consumer bundle of fabrics during a washing cycle in a washing machine, the process comprising:

delivering to a predetermined volume of liquid in the washing machine during a washing stage or a rinse stage of the washing cycle an amount of a liquid extraction agent having a critical micelle concentration of from about 10 ppm to about 1500 ppm in the liquid, such that the predetermined volume of liquid contains from about 10 ppm to about 3000 ppm by weight of the liquid extraction agent, based on the weight of the predetermined volume of liquid, the liquid extraction agent comprising a nonionic silicone surfactant selected from polyalkylene oxide polysiloxanes of formula (I):

$$R^1—(CH_3)_2SiO—[(CH_3)_2SiO]_a—[(CH_3)(R^1)SiO]_b—Si(CH_3)_2—R^1 \quad (I),$$

where a+b is from about 1 to about 50;

each group $R^1$ is selected from the group consisting of methyl and a poly(ethyleneoxide/propyleneoxide) copolymer group of formula (II):

$$—(CH_2)_nO(C_2H_4O)_c(C_3H_6O)_dR^2 \quad (II),$$

where n is 3 or 4, c is from 6 to about 100 for all polyalkyleneoxy side groups, c+d is from about 6 to about 150 for all polyalkyleneoxy side groups, and each $R^2$ is independently selected from the group consisting of hydrogen, an alkyl having 1 to 4 carbon atoms, and an acetyl group;

at least one group $R^1$ in each polyalkylene oxide polysiloxane of formula (I) is a poly(ethyleneoxide/propyleneoxide) copolymer group of formula (II); and each polyalkylene oxide polysiloxane has a weight-average molecular weight of from about 2,000 daltons to about 10,000 daltons, contacting the consumer bundle of fabrics with the liquid in the washing machine such that an effective amount of the liquid extraction agent distributes throughout the consumer bundle of fabrics, and such that the consumer bundle of fabrics acquires a first liquid content consisting of an amount of trapped liquid held interstitially in fabric weaves or void spaces of individual fabrics of the consumer bundle of fabrics, the trapped liquid having a surface tension of 40 mN/m or less; and subjecting the consumer bundle of fabrics to a mechanical extraction to remove at least a portion of the trapped liquid from the consumer bundle of fabrics, such that after said mechanical extraction the consumer bundle of fabrics has a reduced second liquid content, the reduced second liquid content being less than an extraction-only liquid content achievable by performing the same amount of mechanical extraction in the absence of the liquid extraction agent.

2. The process of claim 1, wherein the liquid extraction agent is contacted with the fabric during the rinse stage of the washing cycle and the liquid extraction agent is not deposited on or attached to surfaces or fibers of the fabrics after the rinse stage.

3. The process of claim 1, wherein the liquid extraction agent has a critical micelle concentration of from about 10 ppm to about 300 ppm in the liquid, and the predetermined volume of liquid in the washing machine contains from about 10 ppm to about 300 ppm by weight of the liquid extraction agent, based on the weight of the predetermined volume of liquid.

4. The process of claim 1, wherein the liquid extraction agent further comprises a non-surfactant suds suppressor selected from the group consisting of high molecular-weight hydrocarbons, N-alkylated aminotriazines, monostearyl phosphates, silicone suds suppressors, secondary alcohols, and mixtures of secondary alcohols with silicone oils.

5. The process of claim 4, wherein non-surfactant suds suppressor is a silicone suds suppressor.

6. The process of claim 4, wherein the liquid extraction agent further comprises an additional surfactant selected from the group consisting of anionic surfactants, cationic surfactants, nonionic surfactants, zwitterionic surfactants, fluorosurfactants, and any combination thereof.

7. The process of claim 4, wherein the liquid extract agent further comprises additional agents selected from the group consisting of perfumes, softening agents, anti-wrinkle agents, buffers, enzymes, dispersants, builders, dyes, brighteners, bleaches and any mixture thereof.

8. The process of claim 1, wherein the liquid extraction agent further comprises a liquid extraction agent adjunct for improving packing of the liquid extraction agent at a water-air interface, the liquid extraction agent adjunct comprising an alkyl alcohol.

9. The process of claim 1, wherein c+d of formula (II) is from about 6 to about 100 and the weight-average molecular weight of each polyalkylene oxide polysiloxane is from about 2,000 daltons to about 8,000 daltons.

10. The process of claim 9, wherein d of formula (II) is zero, such each polyalkylene oxide polysiloxane is free of propyleneoxy groups.

11. The process of claim 9, wherein the ratio of ethylene oxide units to propylene oxide units in the nonionic silicone surfactant is from 40/60 to 50/50.

12. The process of claim 1, wherein the nonionic silicone surfactant has a weight average molecular weight of 8,000 daltons and ratio of ethylene oxide units to propylene oxide units of 50/50.

13. The process of claim 1, wherein the liquid extraction agent is contacted with the consumer bundle of fabric immediately prior to the subjecting of the consumer bundle of fabric to the mechanical extraction.

14. The process of claim 1, wherein the liquid extraction agent is delivered in a single dose.

* * * * *

UNITED STATES PATENT AND TRADEMARK OFFICE

CERTIFICATE OF CORRECTION

PATENT NO. : 7,954,190 B2
APPLICATION NO. : 10/865123
DATED : June 7, 2011
INVENTOR(S) : Zhang et al.

It is certified that error appears in the above-identified patent and that said Letters Patent is hereby corrected as shown below:

Column 3

Line 53, delete "40 nN/m" and insert --40 mN/m--.

Column 8

Line 24, in formula VII, delete "$OSO_2M$" and insert --$OSO_3M$--.

Line 34, in formula VIII, delete "$OSO_2M$" and insert --$OSO_3M$--.

Line 43, in formula IX, delete "$OSO_2M$" and insert --$OSO_3M$--.

Line 51, in formula X, delete "$OSO_2M$" and insert --$OSO_3M$--.

Signed and Sealed this
Twenty-seventh Day of March, 2012

David J. Kappos

David J. Kappos
*Director of the United States Patent and Trademark Office*